US011737939B2

(12) United States Patent
Davis

(10) Patent No.: US 11,737,939 B2
(45) Date of Patent: Aug. 29, 2023

(54) SYSTEM AND METHOD FOR PATIENT POSITIONING AND OFFLOADING

(71) Applicant: D.T. Davis Enterprises, LTD., Allentown, PA (US)

(72) Inventor: David T. Davis, Bethlehem, PA (US)

(73) Assignee: D.T. DAVIS ENTERPRISES, LTD., Allentown, PA (US)

( * ) Notice: Subject to any disclaimer, the term of this patent is extended or adjusted under 35 U.S.C. 154(b) by 0 days.

(21) Appl. No.: 17/077,710

(22) Filed: Oct. 22, 2020

(65) Prior Publication Data

US 2021/0121347 A1 Apr. 29, 2021

Related U.S. Application Data

(60) Provisional application No. 62/924,908, filed on Oct. 23, 2019.

(51) Int. Cl.
*A61G 7/10* (2006.01)
*A61G 7/057* (2006.01)

(52) U.S. Cl.
CPC ..... *A61G 7/1036* (2013.01); *A61G 7/05776* (2013.01)

(58) Field of Classification Search
CPC .. A61G 7/1025; A61G 7/1026; A61G 7/1028; A61G 7/1036; A61G 7/05769; A61G 7/05776
See application file for complete search history.

(56) References Cited

U.S. PATENT DOCUMENTS 5,970,545 A * 10/1999 Garman ..... A47C 20/027 5/632
6,073,291 A * 6/2000 Davis ..... A61G 7/05784 414/676
7,007,330 B2 * 3/2006 Kuiper ..... A61G 7/1021 5/733
7,028,350 B1 * 4/2006 Davis ..... A61G 7/1021 5/81.1 R
7,627,910 B2 * 12/2009 Davis ..... A61G 7/103 5/81.1 R
7,725,963 B2 * 6/2010 Johnson ..... B60V 1/06 5/81.1 R
7,861,335 B2 * 1/2011 DeLuca ..... A61G 7/1028 5/81.1 R
8,789,533 B2 * 7/2014 Steffens ..... A61G 7/1025 5/81.1 R
8,984,681 B2 * 3/2015 Ponsi ..... A61G 7/1026 5/81.1 R (Continued)

*Primary Examiner* — David R Hare
*Assistant Examiner* — George Sun
(74) *Attorney, Agent, or Firm* — Duane Morris LLP

(57) ABSTRACT

Methods and systems of patient offloading include positioning an inflatable transfer mattress in a first position with respect to a surface supporting the inflatable transfer mattress. At least one inflatable positioning wedge is positioned in a second position with respect to the surface. The inflatable transfer mattress is positioned in a third position in which a portion of the inflatable transfer mattress overlaps a portion of the at least one inflatable positioning wedge. The at least one inflatable positioning wedge is inflated to transition the portion of the inflatable transfer mattress overlapping the portion of the at least one inflatable positioning wedge to a non-zero angle with respect to the surface.

18 Claims, 12 Drawing Sheets

(56) References Cited

U.S. PATENT DOCUMENTS

| | | | | |
|---|---|---|---|---|
| 9,693,920 | B2 * | 7/2017 | Fowler | A61G 7/001 |
| 10,660,807 | B2 * | 5/2020 | Ribble | A61G 7/018 |
| 10,765,576 | B2 * | 9/2020 | Rigoni | A61G 7/05715 |
| 10,828,216 | B2 * | 11/2020 | Phalen | A61G 7/1028 |
| 10,987,267 | B2 * | 4/2021 | Alvarez | A61G 7/1028 |
| 2009/0222991 | A1 * | 9/2009 | Davis, III | A61G 7/07 5/644 |
| 2015/0040326 | A1 * | 2/2015 | Fairburn | A61G 7/05792 5/713 |
| 2015/0101126 | A1 * | 4/2015 | Reiners | A61G 7/1023 5/715 |
| 2017/0049646 | A1 * | 2/2017 | Rigoni | A61G 7/05769 |
| 2017/0065473 | A1 * | 3/2017 | Scott | A61G 7/05769 |
| 2017/0216117 | A1 * | 8/2017 | Rigoni | A61G 7/05715 |
| 2019/0133857 | A1 * | 5/2019 | Kuiper | A61G 7/05776 |
| 2020/0060909 | A1 * | 2/2020 | Souke | A61G 1/013 |
| 2021/0077327 | A1 * | 3/2021 | Kurt | A61G 7/05769 |

* cited by examiner

SYSTEM AND METHOD FOR PATIENT POSITIONING AND OFFLOADING

CROSS-REFERENCE TO RELATED APPLICATION

This application claims benefit to U.S. Provisional Application Ser. No. 62/924,908, filed Oct. 23, 2019, and entitled "Method for Patient Positioning and Offloading," the entirety of which is incorporated herein by reference.

BACKGROUND

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet. Current patient handling mattresses provide support for patients, but do not provide rotational or turning support.

Immobility and prolonged confinement present both psychological and physically evident pathological problems to patients, ranging from malaise, depression, feelings of helplessness and loss of motivation on the one hand to decubitus ulcers, loss of local circulation and unsanitary dermatologic insult from waste products, or edema of extremities and gangrene on the other. Not only are patients affected by these conditions but so too are the caregivers and clinicians who must lift, turn, wash, change bedding and clothes, arrange for food, treat, and dispose of waste. Within the hospital setting, foam wedges, pillows, and blankets are used to change the position of patients. Position changes of a patient reduce the risk of pressure wounds and help pressure wounds heal. To place the foam wedges, pillows, or blankets under the patient, hospital staff must manually manipulate patients to get the patient positioned in an offloaded position. Such operations often require that attendants have a high level of strength and skill to move and reposition the patient, regardless of the patient's size or weight.

SUMMARY

In various embodiments, a method of patient offloading is disclosed. The method includes steps of positioning an inflatable transfer mattress in a first position with respect to a surface supporting the inflatable transfer mattress, positioning at least one inflatable positioning wedge in a second position with respect to the surface, positioning the inflatable transfer mattress in a third position wherein a portion of the inflatable transfer mattress overlaps a portion of the at least one inflatable positioning wedge, and inflating the at least one inflatable positioning wedge to transition the portion of the inflatable transfer mattress overlapping the portion of the at least one inflatable positioning wedge to a non-zero angle with respect to the surface.

In various embodiments, a method of patient offloading is disclosed. The method includes steps of positioning an inflatable transfer mattress in a first position with respect to a surface supporting the inflatable transfer mattress, slideably positioning at least one inflatable positioning wedge in a second position at least partially between the surface and the inflatable transfer mattress such that a portion of the inflatable transfer mattress overlaps a portion of the at least one inflatable positioning wedge, and inflating the at least one inflatable positioning wedge to transition the portion of the inflatable transfer mattress overlapping the portion of the at least one inflatable positioning wedge to a non-zero angle with respect to the surface.

In various embodiments, a system for patient offloading is disclosed. The system include an inflatable transfer mattress and at least one inflatable positioning wedge. The at least one inflatable positioning wedge is configured to be positioned at least partially between the inflatable transfer mattress and a surface supporting the inflatable transfer mattress such that a portion of the inflatable transfer mattress overlaps a portion of the at least one inflatable positioning wedge. The at least one inflatable positioning wedge is configured to be inflated when positioned at least partially between the inflatable transfer mattress and the surface to transition the portion of the inflatable transfer mattress overlapping the portion of the at least one inflatable positioning wedge to a non-zero angle with respect to the surface.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
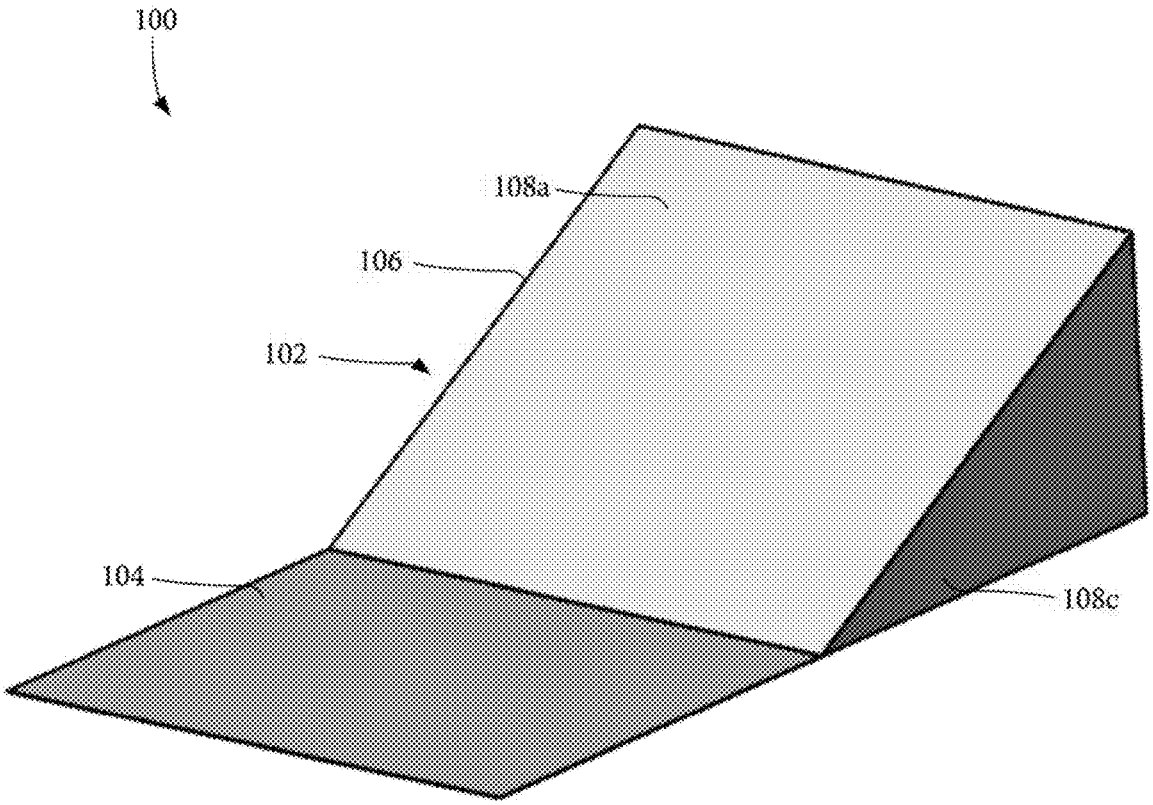
FIG. 1 illustrates a front isometric view of an inflatable patient positioning wedge in an inflated state, in accordance with some embodiments.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship. In the claims, means-plus-function clauses, if used, are intended to cover structures described, suggested, or rendered obvious by the written description or drawings for performing the recited function, including not only structure equivalents but also equivalent structures.

In various embodiments, a system and method for patient positioning and offloading is disclosed. In some embodiments, a system includes an air assisted inflatable transfer mattress and at least one inflatable positioning wedge. The air assisted inflatable transfer mattress may be any suitable inflatable transfer mattress. The inflatable positioning wedge includes at least a top surface, a bottom surface, a first side surface, and a second side surface defining a body. The body of the inflatable positioning wedge defines a predetermined cross-sectional shape, such as a triangle, when the inflatable positioning wedge is in an inflated state. In some embodiments, the inflatable positioning wedge is configured to be substantially flat in a deflated state.

In some embodiments, a method of patient positioning and offloading includes a plurality of steps configured to rotate a patient positioned on an air assisted inflatable transfer mattress to prevent and/or treat pressure injuries. In a first step, a patient transfer mattress having a patient disposed thereon is positioned in a first position with respect to a surface. At least one inflatable positioning wedge is positioned in a second position with respect to the surface. The inflatable transfer mattress is transitioned from the first position to a third position. At least a portion of the inflatable transfer mattress overlaps with at least a portion of an inflatable body of the inflatable positioning wedge. The inflatable positioning wedge is inflated causing the portion of the inflatable transfer mattress overlapping the inflatable positioning wedge to transition from a position substantially planar with the surface to a position having a non-zero angle with respect to the surface. The patient positioned on the inflatable transfer mattress is similarly transitioned to a position having a non-zero angle with respect to the surface, alleviating pressure on certain portions of the patient and reducing or eliminating pressure injuries.

In some embodiments, a method of patient positioning and offloading includes a plurality of steps configured to rotate a patient positioned on an air assisted inflatable transfer mattress to prevent and/or treat pressure injuries. In a first step, a patient transfer mattress having a patient disposed thereon is positioned in a first position with respect to a surface. At least one inflatable positioning wedge is slideably positioned in a second position with respect to the surface such that at least at least a portion of the inflatable transfer mattress overlaps with at least a portion of an inflatable body of the inflatable positioning wedge. The inflatable positioning wedge is inflated causing the portion of the inflatable transfer mattress overlapping the inflatable positioning wedge to transition from a position substantially planar with the surface to a vertical position having a non-zero angle with respect to the surface. The patient positioned on the inflatable transfer mattress is similarly transitioned to a position having a non-zero angle with respect to the surface, alleviating pressure on certain portions of the patient and reducing or eliminating pressure injuries.

Figure 2:
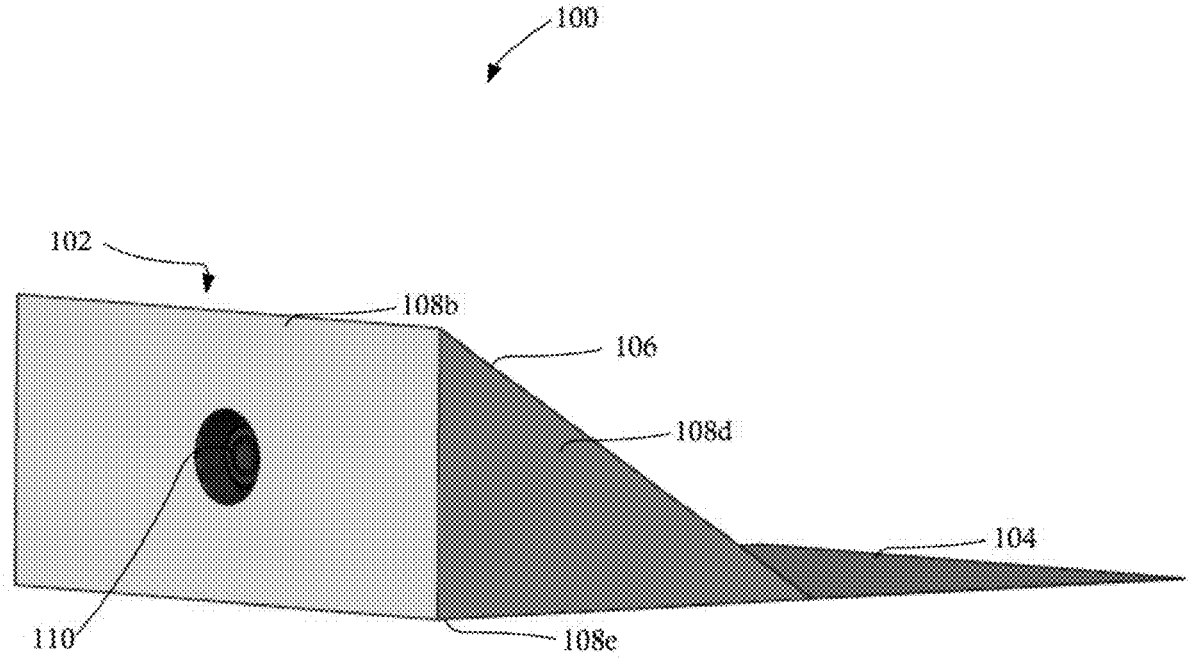
FIG. 2 illustrates a back isometric view of the inflatable patient positioning wedge of FIG. 1, in accordance with some embodiments.

FIGS. 1-2 illustrate an inflatable positioning wedge 100, in accordance with some embodiments. The inflatable positioning wedge 100 includes a positioning portion 102 and a tongue portion 104. The positioning portion 104 includes a body 106 defined by one or more panels 108*a*-108*d*. The panels 108*a*-108*d* define an interior volume configured to receive air flow to transition the body 106 to and/or from an inflated state. In some embodiments, at least one valve 110 provides one-way and/or two-way flow of air into and/or out of the interior volume. The panels 108*a*-108*d* are configured such that the body 106 has a predetermined shaped in an inflated state. In the illustrated embodiment, the body 106 includes a triangular cross-section, although it will be appreciated that panels 108*a*-108*d* may be sized and configured to form any suitable cross-sectional shape.

In some embodiments, the body 106 includes one or more stringers (not shown) configured to provide structural shape and/or support to the inflatable positioning wedge 100. The stringers may be configured to direct air flow into the interior volume in a predetermined manner such that a portion of the interior volume inflates at a first rate and a second portion of the interior volume inflates at a second rate.

In some embodiments, a non-inflatable tongue portion 104 (anchoring portion) is coupled to a first side 114*a* of the inflatable body 106. The tongue portion 104 may be formed of the same material as the panels 108*a*-108*d* and/or may be formed of alternative materials. The tongue portion 104 is configured to be positioned beneath an inflatable mattress and/or other element to anchor the inflatable positioning wedge 100 in a fixed position with respect to a surface, an inflatable mattress, and/or other element. In the illustrated embodiments, the tongue portion 104 defines a rectangular shape, although it will be appreciated that any suitable shape may be defined by the tongue portion 104.

Figure 3:
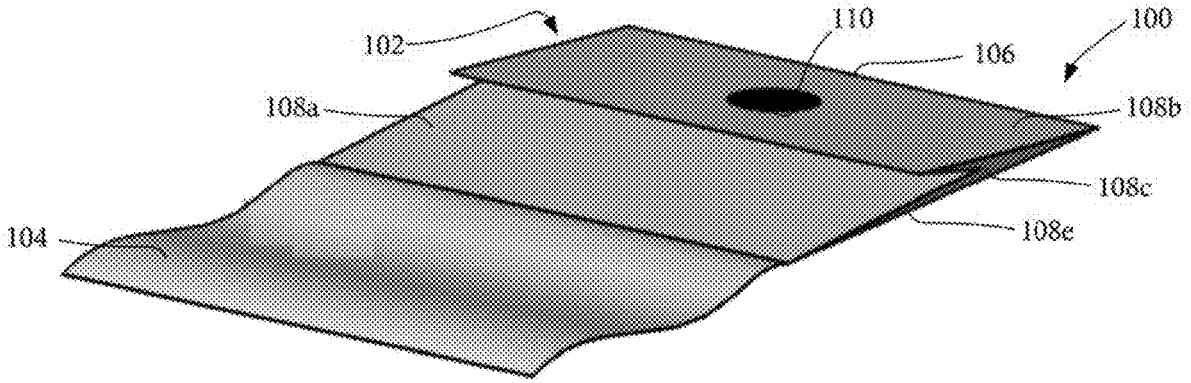
FIG. 3 illustrates a front isometric view of the inflatable patient positioning wedge of FIG. 1 in a deflated state, in accordance with some embodiments.
Figure 4:
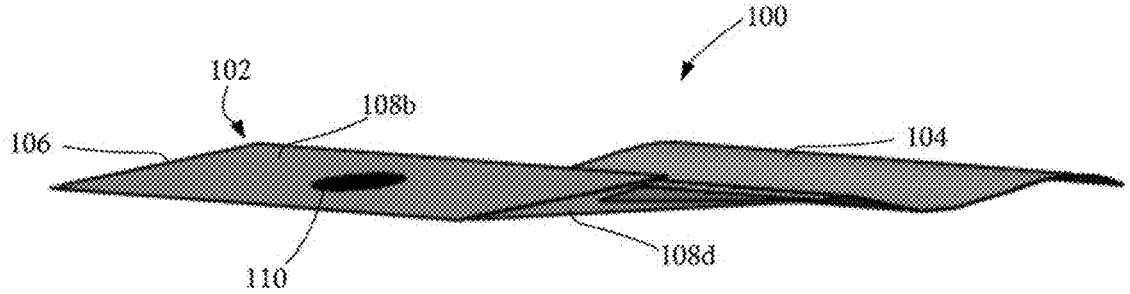
FIG. 4 illustrates a back isometric view of the inflatable patient positioning wedge of FIG. 3, in accordance with some embodiments.

As shown in FIGS. 3-4, in some embodiments, the panels 108*a*-108*d* are configured such that the inflatable positioning wedge 100 is flat when in a deflated state. In a deflated state, the inflatable positioning wedge 100 may be positioned on a surface, such as a hospital bed. An inflatable mattress (or other patient transport/support device) may be positioned at least partially over the inflatable positioning wedge 100. As described in greater detail below, the inflatable positioning wedge 100 may then be transitioned to an inflated state to cause a portion of the inflatable mattress (or other patient transport/support device) to move vertically with respect to the surface. In some embodiments, in a deflated state, the inflatable positioning wedge 100 may be slideably positioned between an inflatable mattress (or other patient transport/support device) and a surface.

Figure 5:
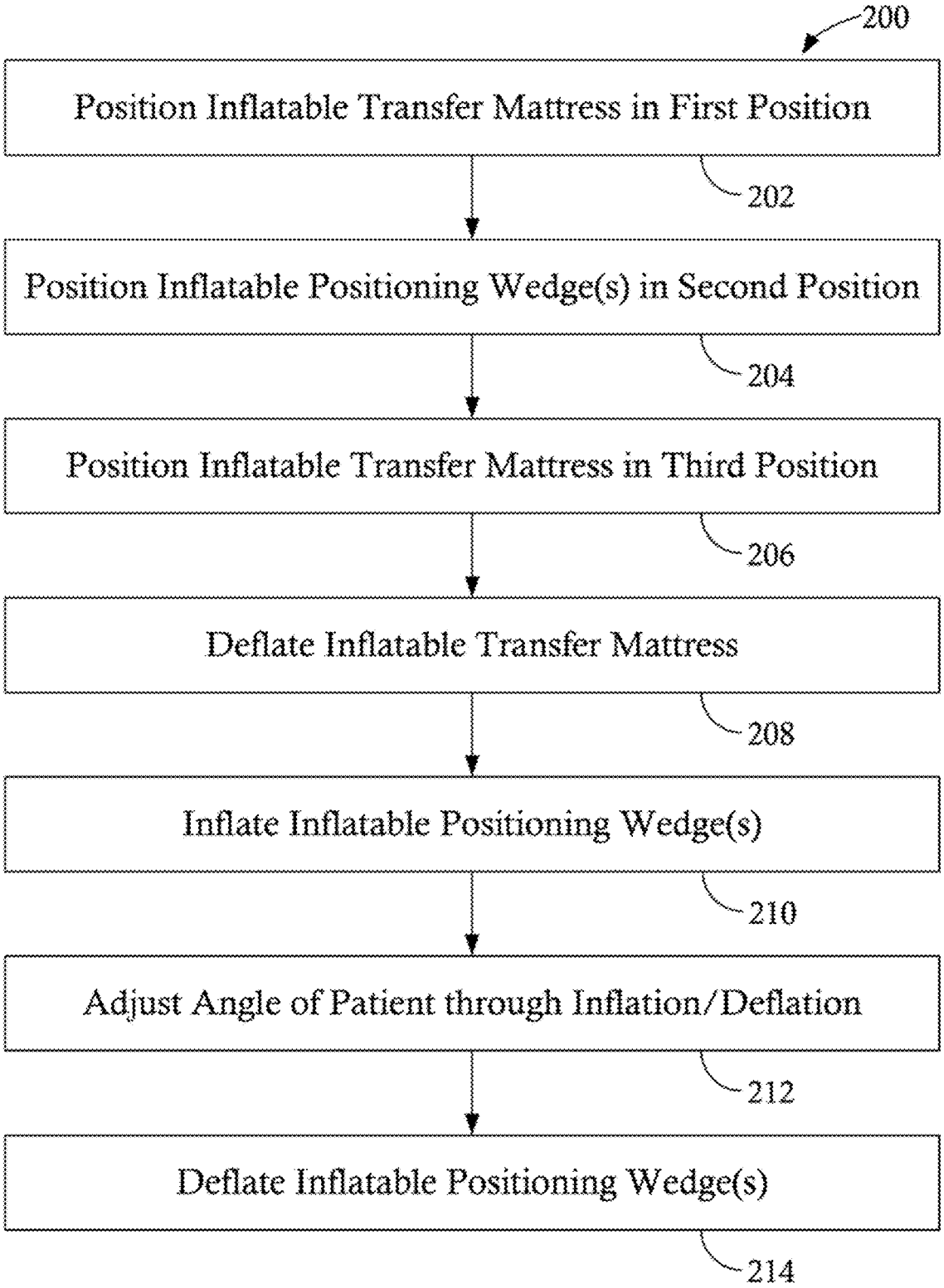
FIG. 5 is a flowchart illustrating a first method of patient positioning and offloading, in accordance with some embodiments.
Figure 6:
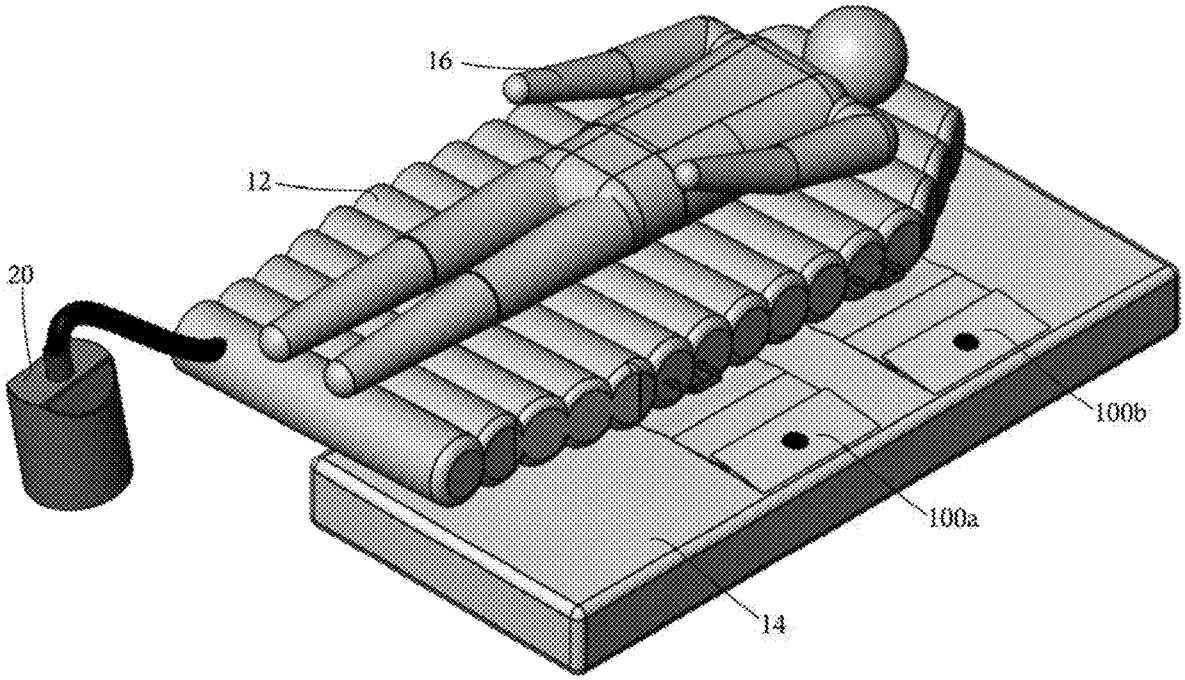
FIG. 6 illustrates a system including an air assisted lateral transfer mattress in an inflated state, a first inflatable patient positioning wedge in a deflated state, and a second inflatable patient positioning wedge in a deflated state, in accordance with some embodiments.

FIG. 5 is a flowchart illustrating a method 200 of positioning and offloading a patient, in accordance with some embodiments. FIGS. 6-10 illustrate a system 10 during various steps of the method 200 of positioning and offloading a patient illustrated in FIG. 5, in accordance with some embodiments. At 202, an inflatable transfer mattress 12 is inflated and positioned at a first position with respect to a surface 14. FIG. 6 illustrates the inflatable transfer mattress 12 in the first position. The inflatable transfer mattress 12 may be positioned beneath a patient 16 prior to performing step 202 of the method 200. For example, in some embodiments, an inflatable transfer mattress 12 may be positioned on a surface 14 prior to positioning of the patient 16 on the surface. Although embodiments are described including a patient "on" a surface 14 or inflatable transfer mattress 12, it will be appreciated that "on" can include contact through one or more intervening layers, such as, for example, an inflatable transfer mattress, inflatable accessory, sheets, towels, absorbent pads, and/or any other suitable intervening layer. In one example, a patient may be positioned on a surface 14 comprising a hospital bed. The inflatable transfer mattress 12 may be positioned on a mattress of the hospital bed prior to positioning the patient 16 on the hospital bed. In other embodiments, an inflatable transfer mattress 12 may be positioned between a patient 16 and a surface 14 after a patient 16 has been positioned on the surface 14. The inflatable transfer mattress 12 may be inflated by any suitable inflation device, such as, for example, pump 20.

Figure 13:
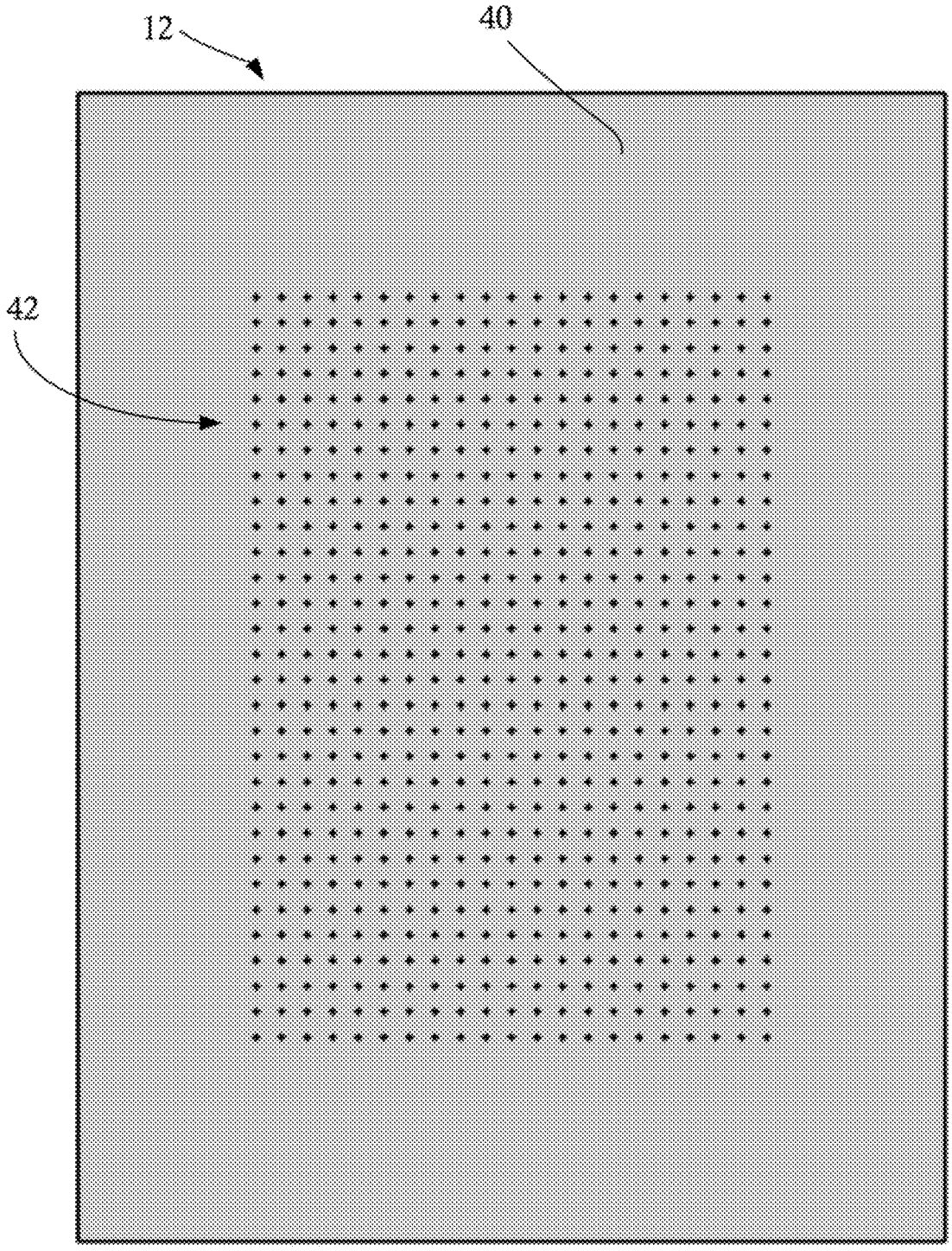
FIG. 13 illustrates a bottom view of an air assisted lateral transfer mattress, in accordance with some embodiments.

In some embodiments, the inflatable transfer mattress 12 includes an air assisted inflatable transfer mattress. The air assisted inflatable transfer mattress includes a plurality of holes in a bottom surface, as illustrated in FIG. 13, configured to provide an air-bearing surface when the air assisted inflatable transfer mattress is inflated. The air-bearing surface allows the inflatable transfer mattress 12 to be moved relative to the surface 16 with little or no frictional resistance. Although embodiments are discussed herein including an air assisted inflatable transfer mattress, it will be appreciated that any suitable inflatable transfer mattress may be used with the present systems and methods.

In some embodiments, the inflatable transfer mattress 12 is inflated beneath a patient in a starting position. In some embodiments, the inflatable transfer mattress 12 and/or the patient 16 may be positioned such that the patient 16 is substantially centered on the inflatable transfer mattress 12. In other embodiments, the inflatable transfer mattress 12 and/or the patient 16 may be positioned such that the patient 16 is positioned substantially adjacent to a first end of the inflatable transfer mattress 12. After being inflated, the inflatable transfer mattress 12 may be transitioned from the starting position to the first position illustrated in FIG. 6.

At step 204, one or more inflatable positioning wedges 100*a*, 100*b* are positioned in a second position with respect to the surface 14, as shown in FIG. 6. In the illustrated embodiments, a first inflatable positioning wedge 100*a* and a second inflatable positioning wedge 100*b* are illustrated. It will be appreciated that any number of inflatable positioning wedges having any suitable size and/or shape may be positioned in a predetermined and/or variable location with respect to the surface 14. For example, in some embodiments, the first and second inflatable positioning wedges 100*a*, 100*b* may be replaced with a single inflatable positioning wedge positioned at a location substantially centered between the illustrated positions of the first and second inflatable positioning wedges 100*a*, 100*b*. As another example, the first inflatable positioning wedge 100*a* may be replaced by two smaller inflatable positioning wedges substantially positioned in the same location as the first inflatable positioning wedge 100*a*. It will be appreciated that any number of various sized inflatable positioning wedges may be used with the disclosed systems and methods.

Figure 7:
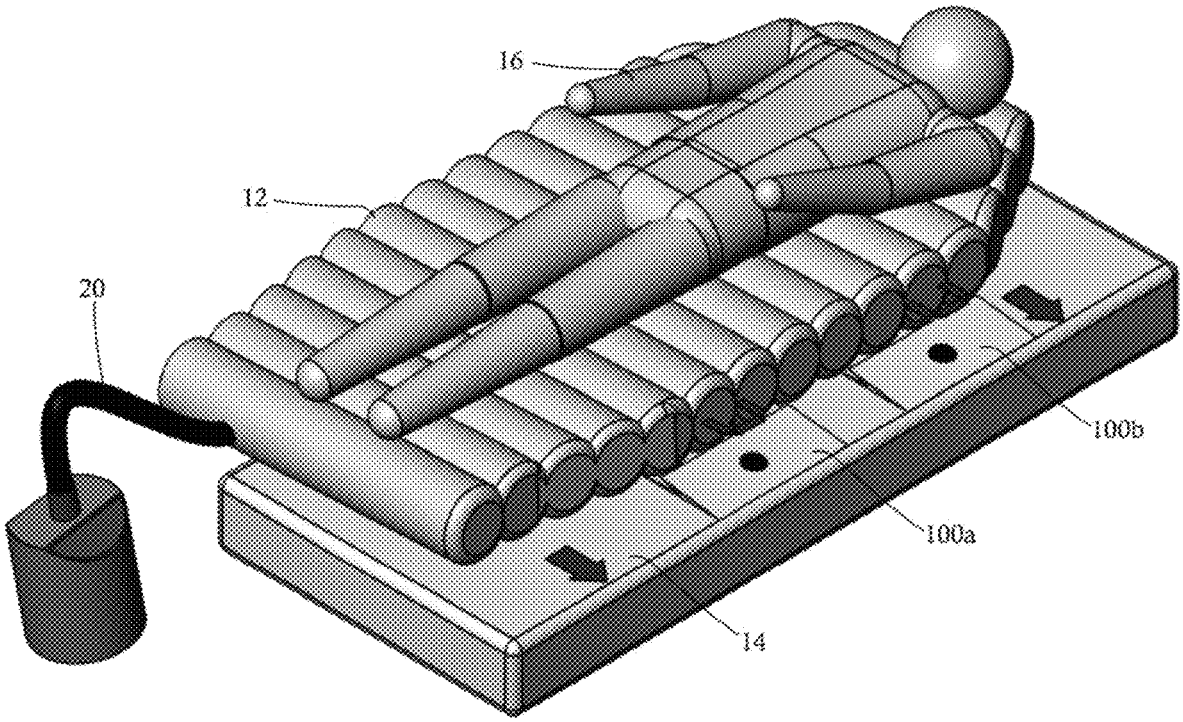
FIG. 7 illustrates the system of FIG. 6 having the air assisted lateral transfer mattress in an intermediate position relative to the first and second inflatable patient positioning wedges, in accordance with some embodiments.

At step 206, the inflatable transfer mattress 12 is laterally transitioned from the first position to a third, or rotation, position. FIG. 7 illustrates the inflatable transfer mattress 12 in the third position. As illustrated in FIG. 7, in the third position, a portion of the inflatable transfer mattress 12 overlaps with each tongue portion 104 and at least a portion of the inflatable portion 102 of the first and second inflatable positioning wedges 100*a*, 100*b*.

Figure 8:
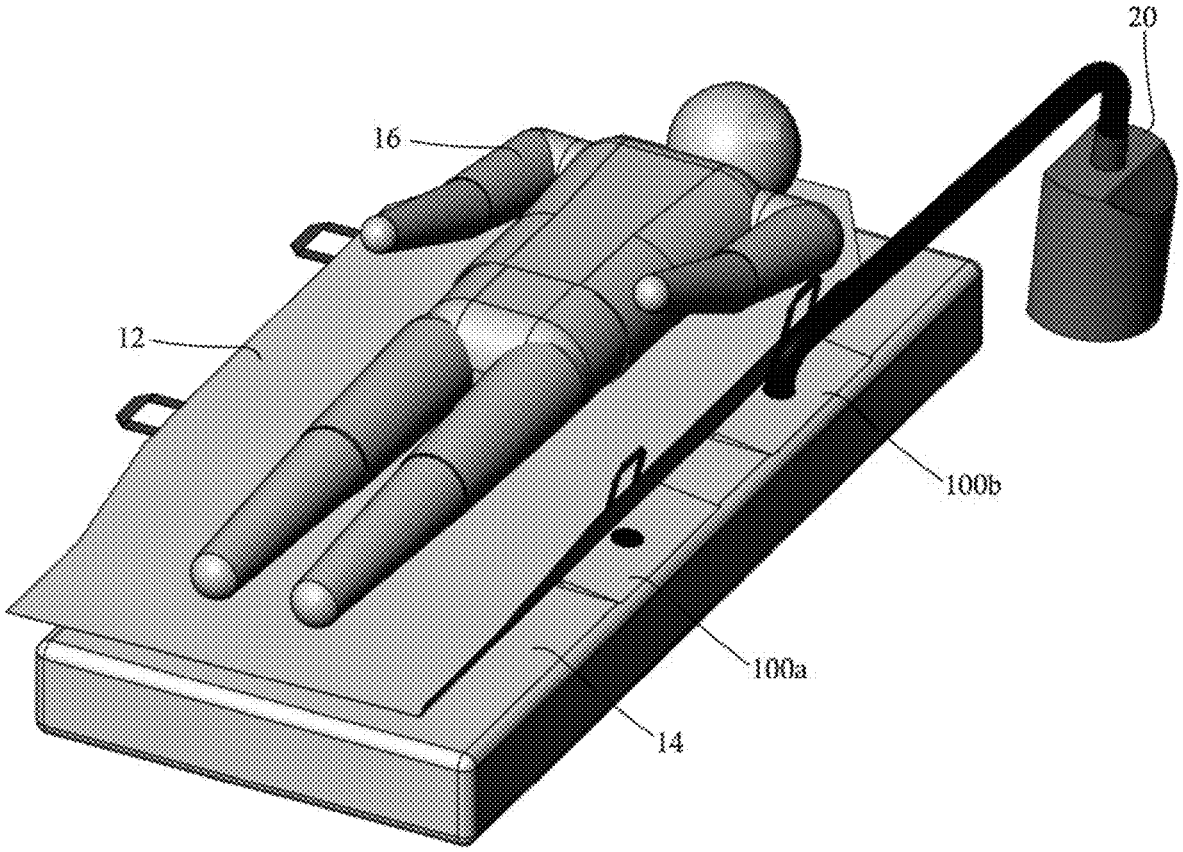
FIG. 8 illustrates the system of FIG. 6 having the air assisted lateral transfer mattress in a rotation position relative to the first and second inflatable patient positioning wedges, in accordance with some embodiments.

At step 208, the inflatable transfer mattress 12 is deflated. FIG. 8 illustrates the inflatable transfer mattress 12 in a deflated state. The inflatable transfer mattress 12 may be deflated using any suitable method, such as, for example, by opening a deflation valve and/or reversing a direction of operation of a pump 20. Deflation of the inflatable transfer mattress 12 causes the patient 16 to be positioned on/vertically closer to the inflatable positioning wedges 100*a*, 100*b*. Although step 208 is illustrated as occurring subsequent to steps 206, it will be appreciated that the inflatable transfer mattress 12 may be deflated prior to transitioning to the third position, i.e., step 208 may be performed prior to step 206. The inflatable transfer mattress 12 may be transitioned to the third, rotation, position in an inflated, partially-inflated, or deflated state.

Figure 9:
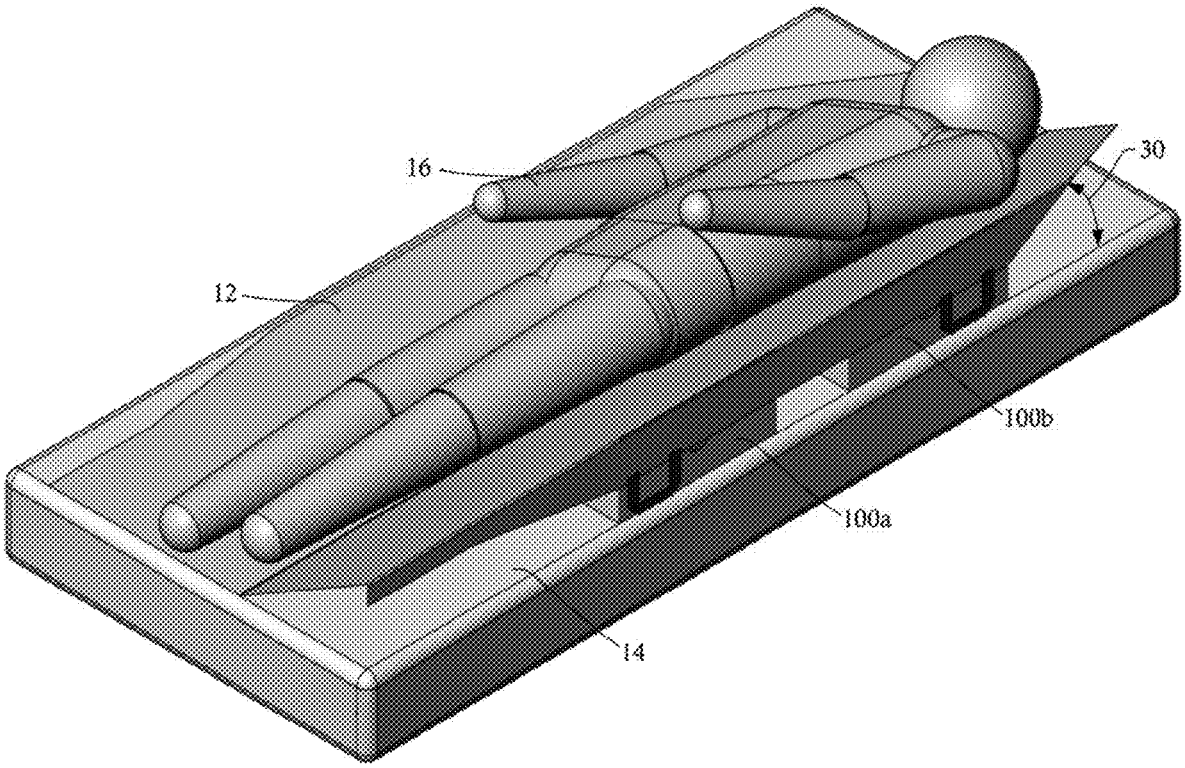
FIG. 9 illustrates an isometric view of the system of FIG. 8 having first and second inflatable patient positioning wedges in an inflated state, in accordance with some embodiments.
Figure 10:
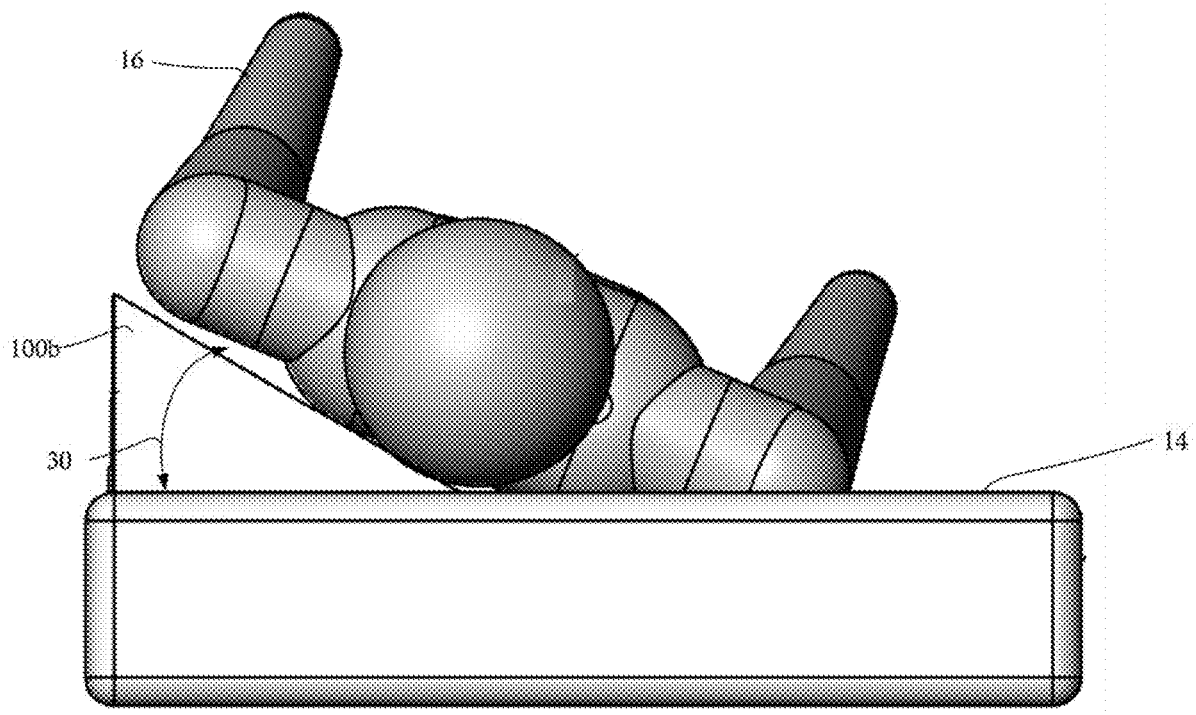
FIG. 10 illustrates a front view of the system of FIG. 9, in accordance with some embodiments.

At step 210, an inflatable body 106 of each of the inflatable positioning wedges 100*a*, 100*b* is inflated to cause the inflatable transfer mattress 12 and the patient 16 to transition from a horizontal position, in which the inflatable transfer mattress 12 and the patient 16 are substantially parallel with a plane defined by the surface 14 as shown in FIG. 8, to an angled position, in which at least a portion of the inflatable transfer mattress 12 and at least a portion of the patient 16 are positioned at a non-zero angle 30 with respect to the surface 14, as shown in FIG. 9. By positioning the patient 16 at a non-zero angle 30 with respect to the surface 14, the pressure and forces exerted on the patient 16 by the surface 14 are reduced or altered, reducing and/or alleviating pressure injuries and allowing existing pressure injuries to heal. By using inflatable positioning wedges 100*a*, 100*b* in combination with an inflatable transfer mattress 100, a patient 16 can be offloaded (i.e., rotated to alleviate pressure injuries or change positions) without exerting strain on the patient 16 or caretakers performing the offloading procedure. The non-zero angle 30 is further illustrated in FIG. 10, which is a front view of the system having the inflatable positioning wedges 100*a*, 100*b* in an inflated state.

At optional step 212, the non-zero angle 30 may be adjusted by adding and/or removing air from the interior volume of each of the inflatable positioning wedges 100*a*, 100*b*. The inflatable positioning wedges 100*a*, 100*b* may be partially deflated (e.g., air removed from the interior volume 110) using any suitable method. In one embodiment, the valve 110 coupled to the body 106 may allow two-way flow of air such that the inflatable body 106 may be inflated and/or deflated using a single valve 110. For example, a valve stem of the valve 110 may be pressed to allow air to exit the internal volume 110. In other embodiments, the valve 110 may be a first valve used for inflation of the inflatable body 106 and a second valve (not shown) may be used to deflate the inflatable body 106.

At option step 214, the inflatable body 106 of each of the inflatable positioning wedges 100*a*, 100*b* may be deflated to return the patient 16 to a position in which the patient 16 is substantially parallel with the plane defined by the surface 14. The inflatable positioning wedges 100*a*, 100*b* may be deflated using any suitable deflation method, such as, for example, opening a deflation valve formed in the body of the inflatable positioning wedges (not shown) and/or reversing the flow of air through a two-way inflation/deflation valve. It will be appreciated that the inflatable positioning wedges 100*a*, 100*b* may be maintained in the second position to allow for additional offloading procedures of the patient 16 and/or may be removed prior to, during, and/or after deflation of the inflatable positioning wedges 100*a*, 100*b*. Although embodiments have been discussed herein including a certain order of steps, it will be appreciated that one or more of the steps 202-212 discussed with respect to FIG. 5 may be performed in an order other than the order shown in FIG. 5.

Figure 11:
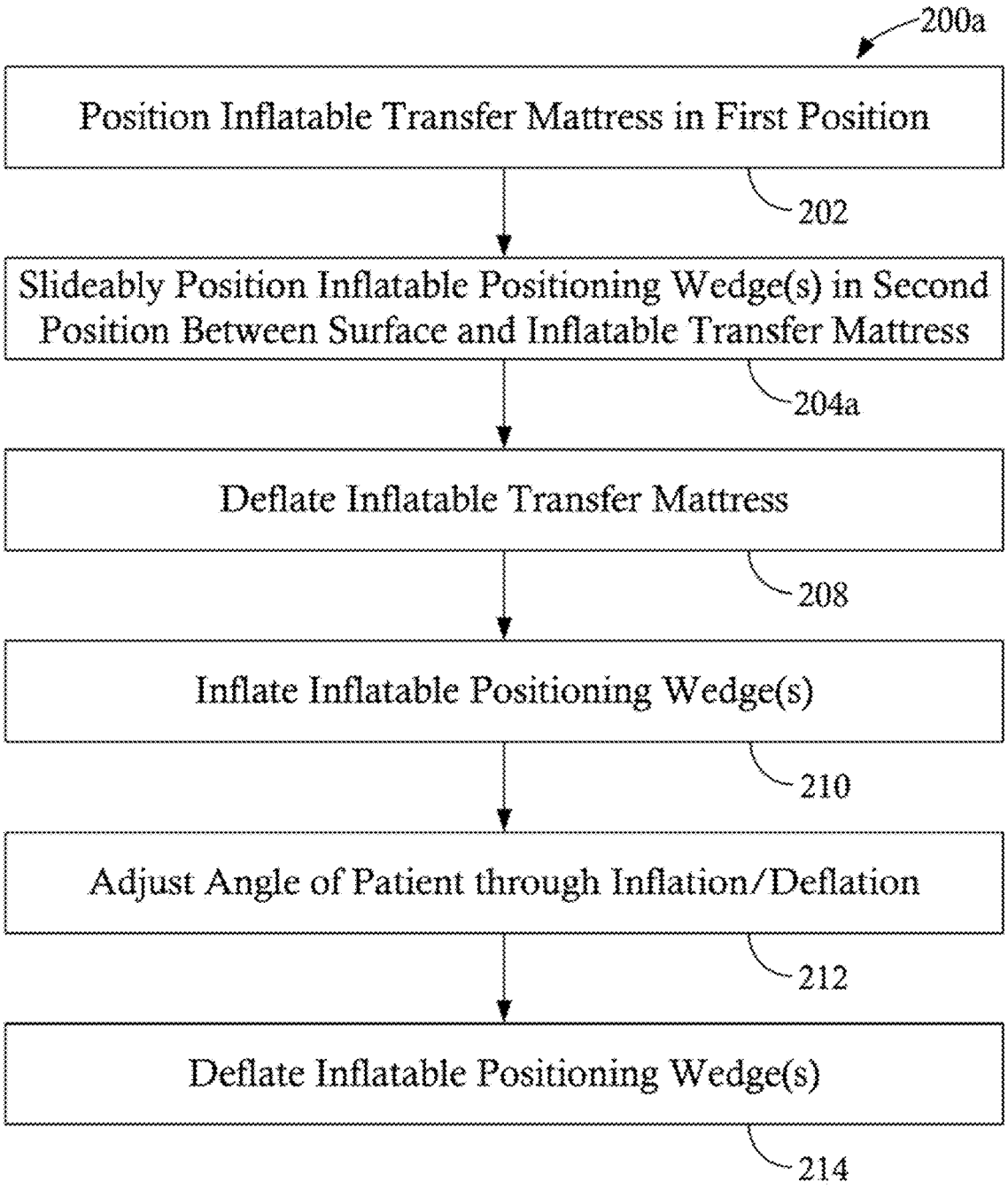
FIG. 11 is a flowchart illustrating a second method of patient positioning and offloading, in accordance with some embodiments.
Figure 12:
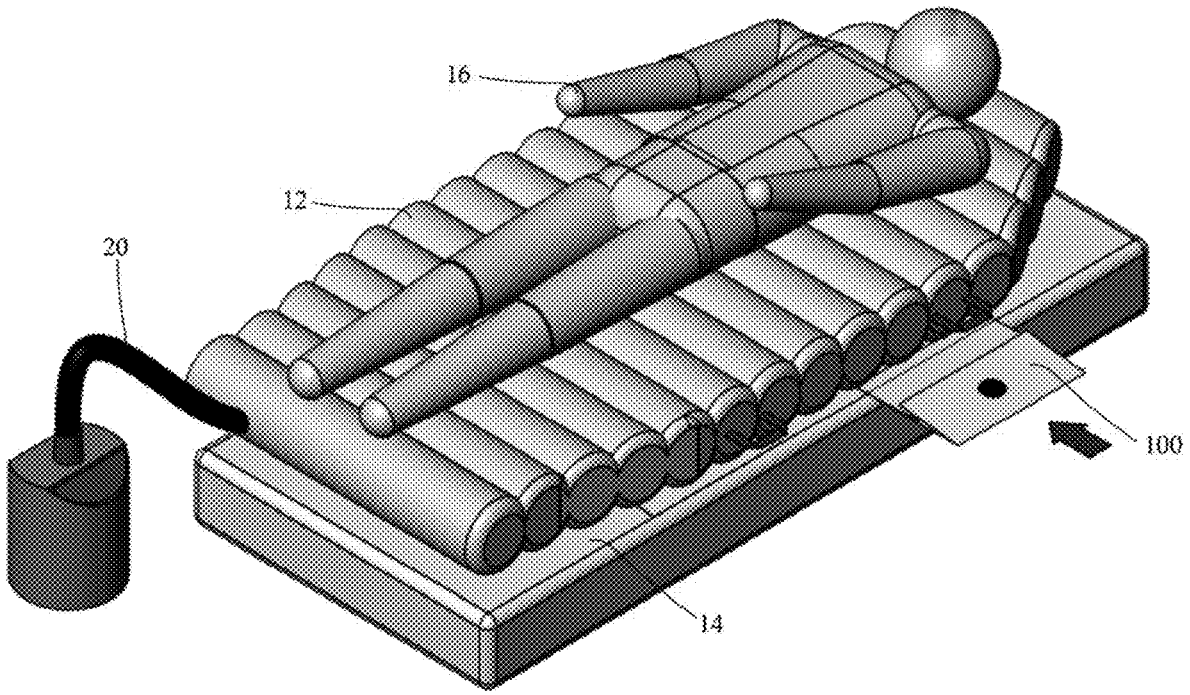
FIG. 12 illustrates a system including an air assisted lateral transfer mattress in an inflated state and an inflatable patient positioning wedge configured to be slideably positioned beneath the air assisted lateral transfer mattress in a deflated state, in accordance with some embodiments.

FIG. 11 is a flowchart illustrating a method 200*a* of positioning and offloading a patient, in accordance with some embodiments. The method 200*a* is similar to the method 200 discussed above in conjunction with FIGS. 5-10, and similar description is not repeated herein. At step 204*a*, one or more inflatable positioning wedges 100*a*, 100*b* are slideably positioned at least partially between the inflatable transfer mattress 12 and the surface 14 while maintaining the inflatable transfer mattress 12 in a substantially fixed position, as illustrated in FIG. 12. For example, in some embodiments, the air bearing surface generated by an air assisted inflatable transfer mattress 12 allows for a tongue portion 104 and at least a portion of an inflatable portion 102 of each inflatable positioning wedge 100*a*, 100*b* to be positioned at least partially beneath the inflatable transfer mattress 12. After step 204*a*, method 200*a* proceeds directly to step 208 and proceeds similarly to method 200.

Although the subject matter has been described in terms of exemplary embodiments, it is not limited thereto. Rather, the appended claims should be construed broadly, to include other variants and embodiments, which may be made by those skilled in the art.

What is claimed is:

1. A method, comprising:

positioning an inflatable transfer mattress in a first position with respect to a surface supporting the inflatable transfer mattress;

inflating the transfer mattress;

positioning at least a first inflatable positioning wedge and a second inflatable positioning wedge in a second position with respect to the surface, wherein the first inflatable positioning wedge and the second inflatable positioning wedge each include a stringer configured to provide structural shape to the respective inflatable positioning; wherein the stringers are configured to direct air flow into the interior volume of the first inflatable positioning wedge and the second inflatable positioning wedge in a predetermined manner such that a portion of the interior volume inflates at a first rate and a second portion of the interior volume inflates at a second rate;

wherein, while in the second position, the inflatable transfer mattress is inflated and the first inflatable positioning wedge and the second inflatable positioning wedge are each positioned along a first side of the inflatable transfer mattress, wherein the first side extends perpendicular to an inflatable thickness direction of the inflatable transfer mattress, and wherein each of the first inflatable positioning wedge and the second inflatable positioning wedge are independently inflatable;

laterally transitioning the inflatable transfer mattress in a third position wherein a portion of the inflatable transfer mattress overlaps a portion of each of the first inflatable positioning wedge and the second inflatable positioning wedge;

after the laterally transitioning step, deflating the inflatable transfer mattress; and inflating both the first inflatable positioning wedge and the second inflatable positioning wedge to transition the portion of the deflated inflatable transfer mattress overlapping the portion of each of the first inflatable positioning wedge and the second inflatable positioning wedge to a non-zero angle with respect to the surface.

2. The method of claim 1, wherein the first positioning wedge and the second positioning wedge are positioned equidistant from a center point of the inflatable transfer mattress.

3. The method of claim 1, wherein the inflatable transfer mattress is inflated prior to being positioned in the first position.

4. The method of claim 1, wherein the at least one inflatable positioning wedge comprises a non-inflatable tongue section and an inflatable body section.

5. The method of claim 4, wherein the inflatable transfer mattress overlaps the non-inflatable tongue section and a portion of the inflatable body section in the third position.

6. The method of claim 1, wherein the inflatable positioning wedge defines a triangular cross-section in an inflated state.

7. The method of claim 6, wherein the inflatable positioning wedge defines a substantially flat cross-section in a deflated state.

8. The method of claim 1, comprising partially deflating the at least one inflatable positioning wedge to adjust the non-zero angle of the inflatable transfer mattress with respect to the surface.

9. The method of claim 1, wherein the first positioning wedge and the second positioning wedge each includes a positioning portion and a tongue portion, the positioning portion includes a body defined by one or more panels that define an interior volume configured to receive air flow to transition the body to an inflated state, and the tongue portion is coupled to a first side of the body and is configured to be positioned beneath the inflatable mattress to anchor a corresponding one of the first and the second inflatable positioning wedges in a fixed position with respect to the surface and the inflatable transfer mattress.

10. A method, comprising:

positioning an inflatable transfer mattress in a first position with respect to a surface supporting the inflatable transfer mattress;

slideably positioning a first inflatable positioning wedge and a second inflatable positioning wedge in a second position at least partially between the surface and the inflatable transfer mattress such that a portion of the inflatable transfer mattress overlaps a portion of the at least one inflatable positioning wedge, wherein the first inflatable positioning wedge and the second inflatable positioning wedge each include a stringer configured to provide structural shape to the respective inflatable positioning; wherein the stringers are configured to direct air flow into the interior volume of the first inflatable positioning wedge and the second inflatable positioning wedge in a predetermined manner such that a portion of the interior volume inflates at a first rate and a second portion of the interior volume inflates at a second rate;

wherein, while in the second position, the first inflatable positioning wedge and the second inflatable positioning wedge are each positioned along a first side of the inflatable transfer mattress, wherein the first side extends perpendicular to an inflatable thickness direction of the inflatable transfer mattress, and wherein each of the first inflatable positioning wedge and the second inflatable positioning wedge are independently inflatable;

after the slideably positioning step, deflating the inflatable transfer mattress; and inflating both the first inflatable positioning wedge and the second inflatable positioning wedge to transition the portion of the deflated inflatable transfer mattress overlapping the portion of each of the first inflatable positioning wedge and the second inflatable positioning wedge to a non-zero angle with respect to the surface.

11. The method of claim 10, wherein the first positioning wedge and the second positioning wedge are positioned equidistant from a center point of the inflatable transfer mattress.

12. The method of claim 10, wherein the inflatable transfer mattress is inflated prior to being positioned in the first position.

13. The method of claim 10, wherein the at least one inflatable positioning wedge comprises a non-inflatable tongue section and an inflatable body section.

14. The method of claim 13, wherein the inflatable transfer mattress overlaps the non-inflatable tongue section and a portion of the inflatable body section when the at least one inflatable positioning wedge is in the second position.

15. The method of claim 10, wherein the inflatable positioning wedge defines a triangular cross-section in an inflated state.

16. The method of claim 15, wherein the inflatable positioning wedge defines a substantially flat cross-section in a deflated state.

17. The method of claim 10, wherein the first positioning wedge and the second positioning wedge each includes a positioning portion and a tongue portion, the positioning portion includes a body defined by one or more panels that define an interior volume configured to receive air flow to transition the body to an inflated state, and the tongue portion is coupled to a first side of the body and is configured to be positioned beneath the inflatable mattress to anchor a corresponding one of the first and the second inflatable positioning wedges in a fixed position with respect to the surface and the inflatable transfer mattress.

18. A system, comprising:

an inflatable transfer mattress;

a first inflatable positioning wedge; and a second inflatable positioning wedge, an entirely separate structure from the first inflatable positioning wedge, wherein the first inflatable wedge and the second inflatable positioning wedge each include a stringer configured to provide structural shape to the respective inflatable positioning wedge, wherein the stringers are configured to direct air flow into the interior volume of the first inflatable positioning wedge and the second inflatable positioning wedge in a predetermined manner such that a portion of the interior volume inflates at a first rate and a second portion of the interior volume inflates at a second rate;

the first and the second inflatable positioning wedges are configured to be positioned at least partially between the inflatable transfer mattress and a surface supporting the inflatable transfer mattress such that a portion of the inflatable transfer mattress overlaps a portion of each of the first and the second inflatable positioning wedges, and each of the first and the second inflatable positioning wedges is configured to be independently inflated when positioned at least partially between the inflatable transfer mattress and the surface to transition the portion of the inflatable transfer mattress overlapping the portion of the first or the second inflatable positioning wedges to a non-zero angle with respect to the surface.

* * * * *